United States Patent [19]

Funamoto et al.

[11] Patent Number: 5,020,929

[45] Date of Patent: Jun. 4, 1991

[54] PAPER FEED DEVICE

[75] Inventors: Masaya Funamoto, Nagoya; Akira Kobayashi, Anjyo, both of Japan

[73] Assignee: Brother Kogyo Kabushiki Kaisha, Japan

[21] Appl. No.: 458,298

[22] Filed: Dec. 28, 1989

[30] Foreign Application Priority Data

Dec. 29, 1988 [JP] Japan ..... 63-331792

[51] Int. Cl.[5] ..... B41J 13/02

[52] U.S. Cl. ..... 400/639.1; 400/636.1

[58] Field of Search ..... 400/636, 636.1, 637, 400/637.1, 637.2, 638, 639, 639.1, 639.2, 641, 605

[56] References Cited

U.S. PATENT DOCUMENTS 4,217,057 8/1980 Nakamura ..... 400/636.1
4,722,624 2/1988 Musso ..... 400/636.1
4,859,099 8/1989 Kanemoto et al. ..... 400/636.1
4,883,375 11/1989 Karube et al. ..... 400/638

*Primary Examiner*—Eugene H. Eickholt
*Attorney, Agent, or Firm*—Kane, Dalsimer, Sullivan, Kurucz, Levy, Eisele and Richard

[57] ABSTRACT

In an automatic paper feed device having a platen and a paper bail arranged to be brought into and out of contact with the platen, the paper bail is further constituted to be brought into contact during a paper is fed in an predetermined amount, and to be brought out of contact during the paper is further fed. The shift operation of the paper bail is controlled by a release mechanism including a driven gear arranged to be rotated with the platen and an intermittent gear arranged to be brought engagement in a predetermined range of angle. Thus, it is possible to design the release mechanism freely since the paper is preliminarily fed without shifting the paper bail.

16 Claims, 10 Drawing Sheets

PAPER FEED DEVICE

BACKGROUND OF THE INVENTION

The present invention relates to a paper feed device employed in a printing apparatus for automatically feeding a printing paper, more particularly to a device for feeding a printing paper to a platen for a predetermined amount and for operating a release mechanism for releasing a paper bail having been brought into contact with the platen so that a paper is smoothly fed between the platen and the paper bail.

Conventionally, a printing apparatus such as a typewriter which is equipped with an automatic paper feed device in which a printing paper is fed to a platen by an operation of a paper insert key provided on the printing apparatus and by releasing operation of a paper bail which is usually pressed to the platen by a release mechanism which is provided with an intermittent gear, release cam, and so forth from the platen, whereby the printing paper is smoothly fed between the platen and the paper bail has been used.

Generally, in the automatic paper feed device, for example, when a diameter of the platen is approx. 36 mm, the paper feed length necessary for the automatic paper feed operation is approx. 75 mm. When the printing paper is fed for the paper feed length, the rotation angle of the driven gear disposed at the platen is approx. 220°, for example. In addition, the paper bail is arranged to be placed in a release position where the paper bail is released from the active position in which the paper bail and the platen are brought into contact with each other until the printing paper is fed for a predetermined length and a leading end of the printing paper arrives in a position higher than the paper bail just after the automatic paper feed operation is started so that the printing paper can be smoothly fed between the paper bail and the platen.

To do that, a release cam is provided for an intermittent gear which is arranged to be engaged with the driven gear as a release mechanism of the paper bail, thereby rocking a paper bail arm on which the paper bail is supported.

The driven gear is normally made with the nearly same diameter as that of the platen. The driven gear is rotatable driven by a line feed motor through an intermediate gear. There are needs for increasing the degree of freedom in designing the paper feed device by freely selecting the speed reduction ratios of the line feed motor, driven gear, and intermittent gear and the diameter of the intermittent gear, thereby reducing a size thereof.

When the size of the intermittent gear becomes small, the speed reduction ratio of the intermittent gear against the motor gear which drives the driven gear becomes small. Thereby, the rotation angle after the paper feed is started until it is ended becomes large. The timing on which the paper bail is moved from the release position to the contact position becomes much faster than that on which the automatic paper feed operation is ended and thereby the printing paper being fed tends to be disturbed by the paper bail.

On the other hand, it is possible to take a countermeasure for decreasing the diameter of the driven gear in accordance with the size of the intermittent gear, because the speed reduction ratios from the line feed motor to the driven gear increases. Therefore, the size of the line feed motor becomes large.

Accordingly, in the conventional automatic feed device described above, the although the speed reduction ratios from the line feed motor to the driven gear can be set to larger values, the release mechanism including the intermittent gear becomes large, resulting in decreasing the degree of freedom in designing the device.

To solve such problems, it may be considered that a release mechanism having a tailed release cam is employed, as shown in FIGS. 1(A) and 1(B). As shown in FIG. 1(B), even when the driven gear 61 is turned for approx. 217° in the automatic paper feed state and the intermittent gear 62 is remarkably turned for approx. 335°, the tail portion 60*a* can securely delay the moving timing on which the paper bail 63 is moved to the contact position.

However, in the release mechanism having the tailed release cam as shown in FIGS. 1(A) and 1(B), a shape of the release cam becomes complicated and thereby an operability and an durability thereof decrease.

SUMMARY OF THE INVENTION

It is therefore an object of the invention to provide an improved automatic paper feed device for a printing apparatus capable of increasing a degree of freedom in designing it, and decreasing a size of a release mechanism for separating a paper bail from a platen during an automatic paper feed operation.

For this purpose, according to the invention, there is provided a paper feed device comprises:

a platen member arranged to be rotated by a drive motor member;

a paper bail member provided parallel to said platen member, said platen member and said paper bail member being arranged to be relatively movable with each other; and control means for controlling said drive motor member, said platen member and said paper bail member in such a manner that said platen member and said paper bail member are brought out of contact after said platen member is driven to be rotated at a first predetermined angle, while said platen member and said paper bail member are brought into contact with each other after said platen member is further driven to be rotated at a second predetermined angle and perpendicularly provided with said platen member and arranged to be brought into and out of contact with said platen member, said paper bail member being biased toward said platen member by a first biasing force generated by a first biasing member; and first control means for controlling said drive motor member and said paper bail member in such a manner than said paper bail member is brought out of contact from said platen member after said platen member is driven to be rotated at a first predetermined angle, while said paper bail member is brought into contact with said platen member after said platen member is further driven to be rotated at a second predetermined angle.

DESCRIPTION OF THE ACCOMPANYING DRAWINGS

FIGS. 1(A) and 1(B) are descriptive schematic showing each state, a platen and a paper bail are brought into and outer of contact with each other, of a release mechanism with a trailed release cam devised before the present invention;

DESCRIPTION OF THE EMBODIMENTS

Referring to the figures, an embodiment of the present invention is described hereinafter.

The present embodiment is an automatic paper feed device employed in an electronic typewriter.

Figure 2:
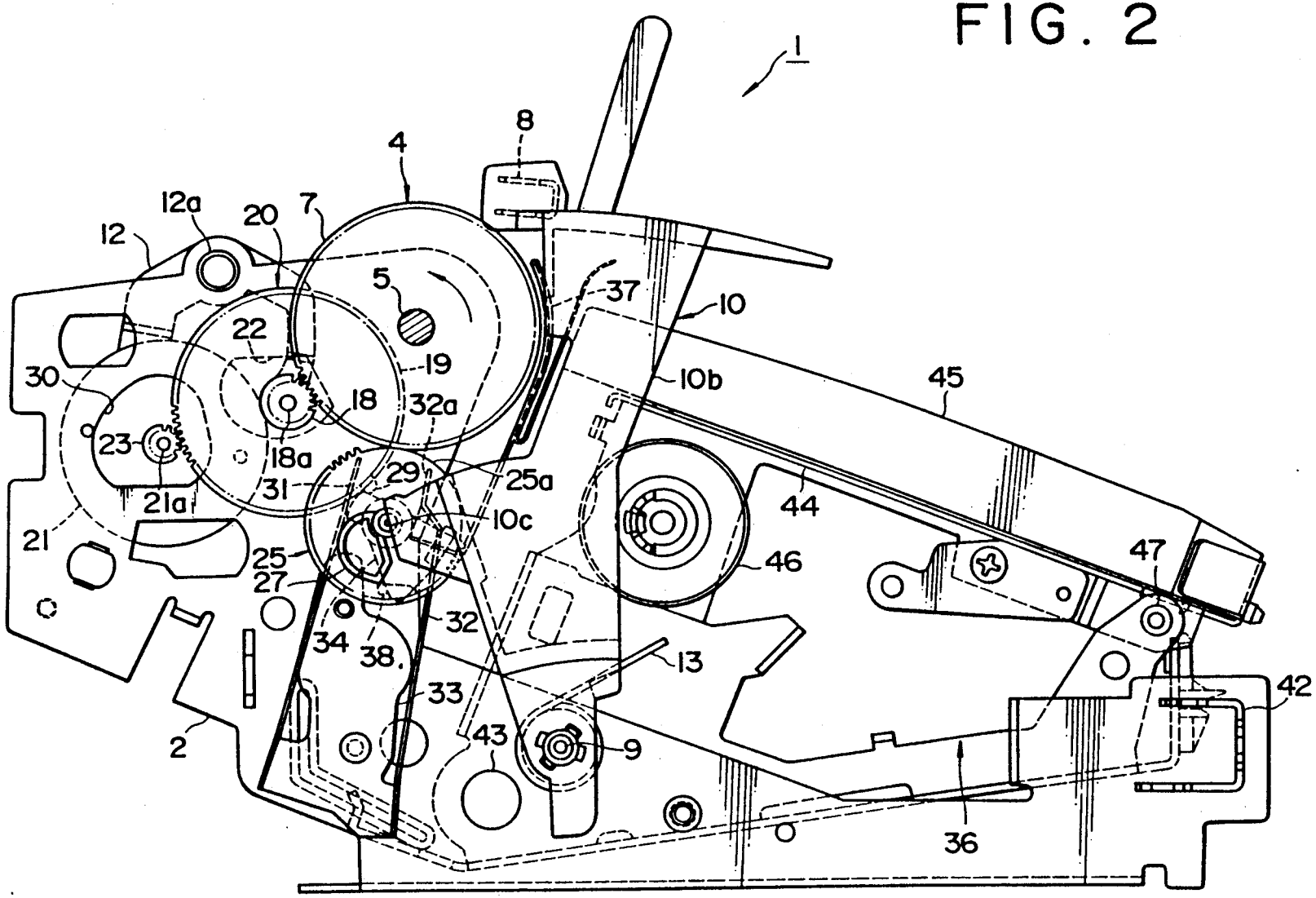
FIG. 2 is a side view of a printing apparatus incorporating a paper feed device according to the present invention.
Figure 3A:
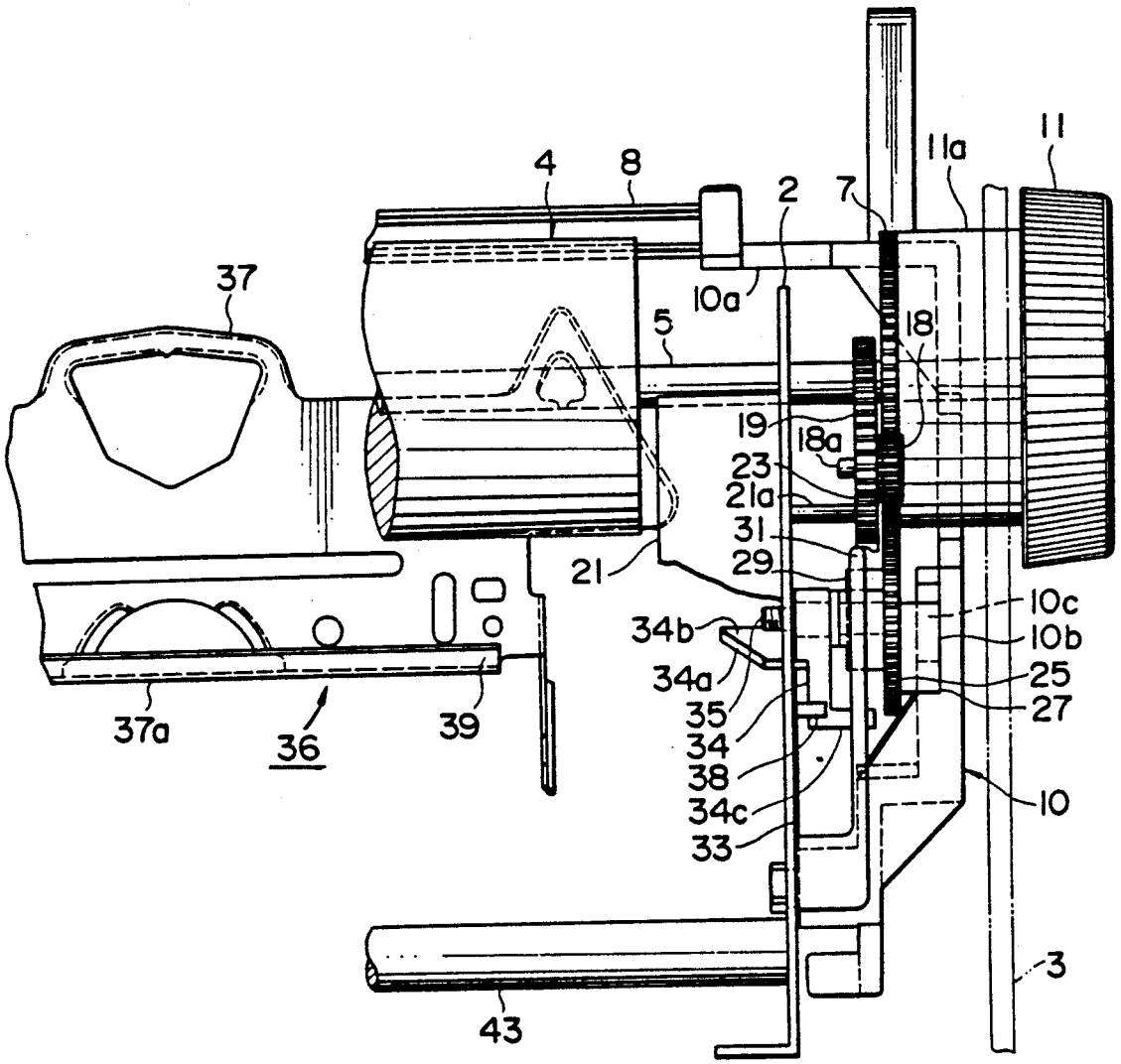
FIG. 3(A) is a rear view of the peripheral section of the printing apparatus of FIG. 2.
Figure 3B:
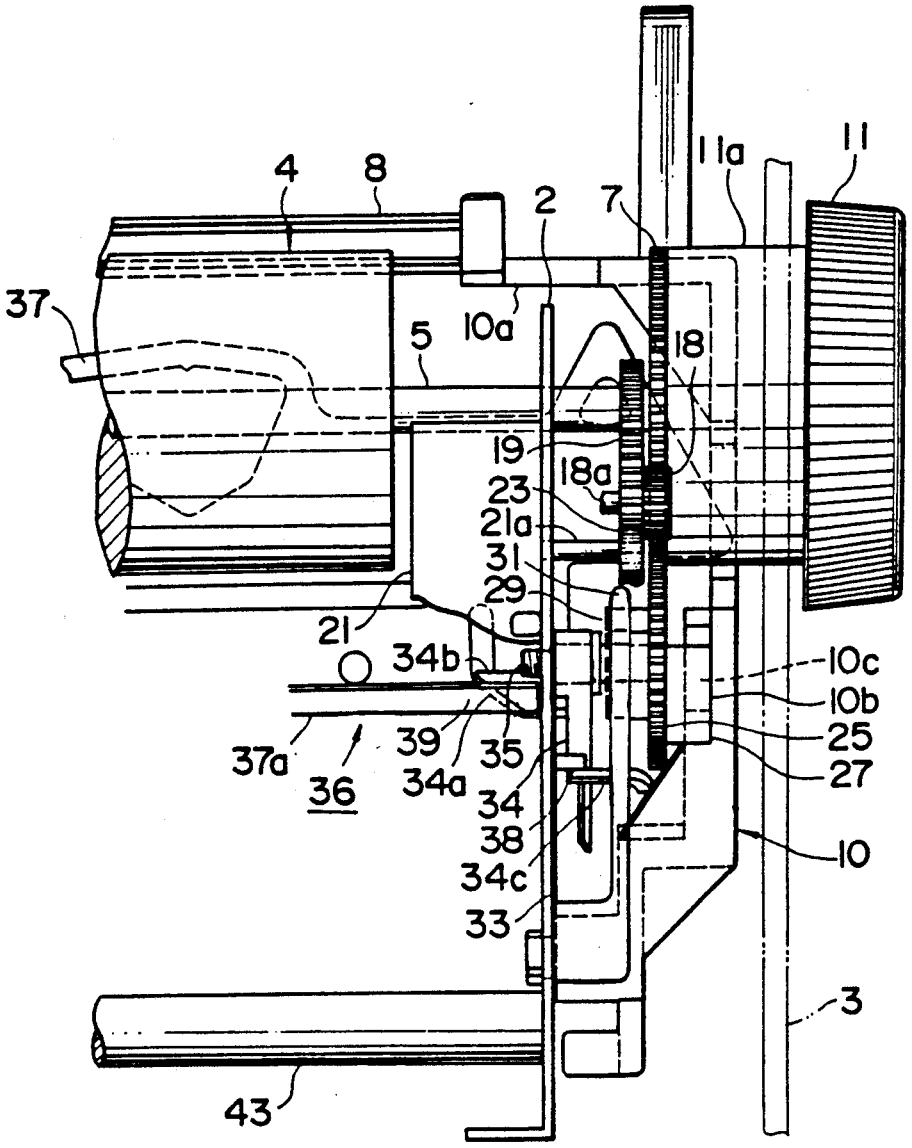
FIG. 3(B) is the rear view, wherein a carriage provided in the printing apparatus is moved to the leftmost position.

As shown in FIGS. 2, 3(A) and 3(B), at both ends inside a typewriter 1, side wall plates 2 (unit frame) are individually disposed. A platen 4 disposed between the pair of side wall plates 2 is rotatably supported by the left and right side wall plates 2 adjacent to both the ends of a platen shaft 5, a driven gear 7 and a platen knob 11 being fixed at the left end of the platen shaft 5.

The driven gear 7, a large diameter shaft 11*a* disposed externally thereof, and the platen knob 11 are integrally formed with the shaft 11*a*. The platen knob 11 is disposed outside a casing side plate 3.

A paper bail 8 is disposed in parallel with the platen 4. The left end portion of the paper bail 8 is fixed to the inner end portion of a horizontal arm portion 10*a* at the top portion of a paper bail arm 10 (rocking arm) rotatably pivoted to a pin 9 fixed to the left side wall plate 2, the right end portion being fixed to the inner end portion of the horizontal arm portion 10*a* at the upper end portion of the paper bail arm 10 rotatably pivoted to the pin 9 fixed to the right side wall plate 2. A return spring 13 made by an elastic material is externally provided to the pin 9. One end of the return spring 13 is fixed by a crank shape fixing portion at the lower end of the paper bail arm 10, the other end portion being fixed by the side wall plate 2. An another return spring, not shown, which is weaker than the return spring 13 is disposed between the lower end of the right side paper arm 10 and the side wall plate 2. The paper bail 8 is structured so that one of two position, namely the contact position where the paper bail 8 is contacted with the platen 4 through the paper bail arm 10 and the release position where the paper bail 8 is separated from the platen 4 can be switched. When the platen 4 is in the contact position, the upper rear end of the left paper bail arm 10 is contacted with the large diameter shaft 11*a* and a gap of several millimeters is made between the paper bail 8 and the platen 4. The paper bail 8 is elastically tensioned to the platen 4 by the return spring 13 and the right side return spring. The paper bail 8 is made of a rigid metal part whose sectional shape is a left-side open square. The left and right paper bail arms 10 are not mutually twisted.

The left and right paper bail arms 10 are composed of the horizontal arm portion 10*a* and a side plate portion 10*b* which is extended downwardly inside the casing side plate 3. The side plate portion 10*b* is widened in the front and rear directions. It is bent in a crank shape at the lower portion.

As shown in FIG. 2, an intermediate gear 20 composed of a small diameter gear 18 and a large diameter gear 19 which is larger than thereof is disposed at a rear portion of the driven gear 7. The driven gear 7 is arranged to be brought into engagement with the small diameter gear 18. A line feed motor 21 is disposed inside the side wall plate 2 at the rear of the intermediate gear 7. A driving gear 23 fixed to a driving shaft 21*a* is arranged to be brought into engagement with the large diameter gear 19 of the intermediate gear 20. A reverse "U" shape bracket 12 is integrally formed to a mounting flange 21*b* of the motor 21. The top portion of the bracket 12 is rotatably pivoted to the side wall plate 2 by a shaft 12*a*. A shaft 18*a* fixed to the bracket 12 is horizontally extended through an opening portion 22 of the side wall plate 2. The intermediate gear 20 is rotatably pivoted to the end of the shaft 18*a*. The driving shaft 21*a* of the line feed motor 21 is horizontally extended through an opening portion 30 of the side wall plate 2. The driving gear 23 is fixed to the end of a driving shaft 21*a*. The positions of the line feed motor 21 and the intermediate gear 20 are adjusted by turning the mounting flange 21*b* and the bracket 12 around the shaft 12*a*. After that, the line feed motor 21 and the intermediate gear 20 are fixed to the side wall plate 2 with machine screws and the like, not shown.

When a return key or print line key on a keyboard provided on the electronic typewriter is operated, the line feed motor 21 is driven by a control unit. described later, and thereby the driven gear 7 is driven through the driving gear 23 and the intermediate gear 20 and the platen 4 is rotated, so that a printing paper is fed for a predetermined length.

By referring to FIGS. 2 through 4, an operation of a release mechanism 24 for switching the paper bail 8 to the release position in feeding the printing paper to the platen 4 is described hereinafter.

Figure 4:
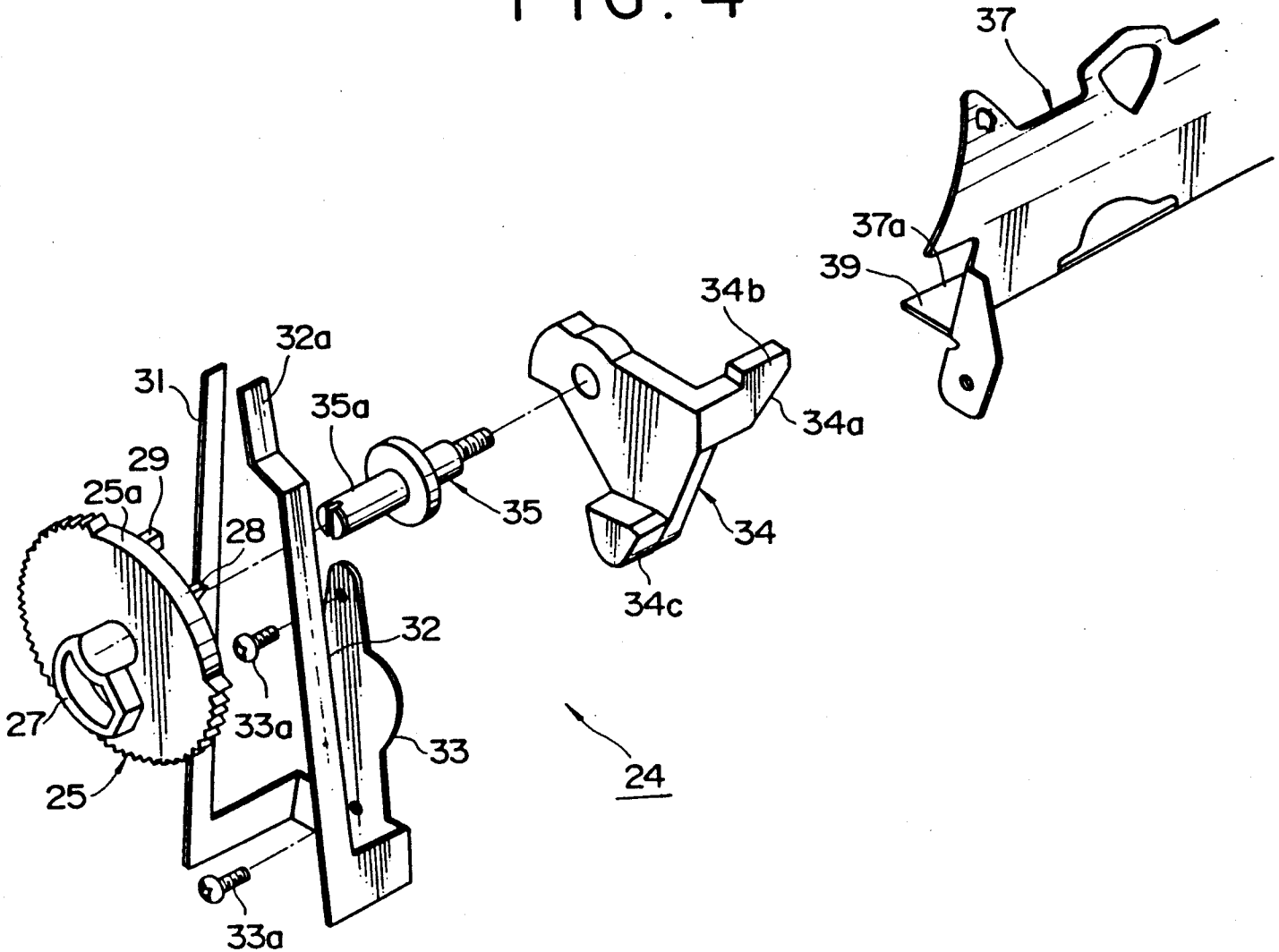
FIG. 4 is a perspective exploded view of a release mechanism incorporated in the paper feed device according to the present invention.

Just below the driven gear 7, as shown in FIG. 4, a synthetic resin release part 34 is rotatably pivoted to the outside of the side wall plate 2 by a shoulder screw 35. An intermittent gear 25 is rotatably pivoted to a shaft 35*a* of the shoulder screw 35 extended to the outside of the release part 34. On the periphery of the intermittent gear 25, an intermittent portion 25*a* where gear teeth are not provided is formed for approx. 130°. A gear portion except for the intermittent portion 25*a* is formed so that it can be brought into engagement with the driven gear 7.

At the left end of the intermittent gear 25, a release cam 27 is integrally formed. The release cam 27 is gradually released from the center position of the shaft 35*a* on the reading side, the release cam 27 having a cam surface whose radius is constant in a predetermined range. At the rear end of the middle stage of the side plate portion 10*b* of the left side paper bail arm 10, a cam driven portion 10*c* is provided. The cam driven portion 10*c* is slidably contacted with the cam surface of the release cam 27 where the cam driven portion 10*c* is rotated in accordance with the rotation of the intermittent gear 25. Thereby, the left and right paper bail arms 10 are rotated in the front and rear directions.

A pin 29 is extruded at a portion according to the trailing edge of the intermittent portion 25*a* at the right end of the intermittent gear 25. At a portion according to the center of the intermittent portion 25*a*, an isosceles triangle shape stopper 28 whose vertical angel is 30° viewed from the side face is integrally formed.

A first leaf spring 31 contacted from the rear of the pin 29 for rotatably tensioning the intermittent gear 25 clockwise and a second leaf spring 32 contacted with the front of the stopper 28 for fixing the stopper 28 against the rotatable tension of the first leaf spring 31 for opposing the intermittent portion 25*a* of the intermittent gear 25 to the driven gear 7 are disposed downwardly from the inside of the intermittent gear 25. The first leaf spring 31 and the second leaf spring 32 are formed in a shape of character "L" when viewed from the top. The lower ends of both the leaf springs 31 and 32 are integrally formed on a common mounting plate 33. The mounting plate 33 is fixed on the outer surface of the side wall plate 2 with two machine screws 33*a*, 33*a*. A contact portion 32*a* which is contacted with the stopper 28 at the upper end of the second leaf spring 32 is deformed backwardly by two bent positions. This contact portion 32*a* causes the front of the stopper 28 to be locked.

At the front end of the release part 34 which is axially, independently, rotatably disposed inside the intermittent gear 25, an operation engagement portion 34*b* having a guide face 34*a* which is extruded inwardly from the front of the side wall plate 2 and which externally inclined is formed. At the lower end of the front of the release part 34, a release operation portion 34*c* which is opposed to the second leaf spring 32 away from the rear of the second leaf spring 32 for a predetermined length is formed. The release part 34 is fixed from the back in a predetermined position by a fixing piece 38 which is projected from the side wall plate 2. The guide face 34*a* of the operation engagement portion 34*b* is opposed to a position at the left of an operation cam piece 39 at the left end of a flange 37*a* at the lower end of a paper mater 37 disposed with a carriage 36 which is arranged to be moved along a platen 4. When the carriage 36 is moved to the left limit side moving position in an automatic paper feed mode, as shown in FIG. 3(B), the guide face 34*a* is upwardly pushed by the operation cam piece 39 and the operation engagement portion 34*b* is upwardly rotated. Thereby, the release part 34 is rotated clockwise for a predetermined angle and the second leaf spring 32 is pushed forwardly, that is, to an engagement release position in which the stopper 28 and the contact portion 32*a* are not contacted with each other by the release operation portion 34*c*. The lower portion of the rear end of the carriage 36 is, as shown in FIG. 2, movably supported leftwardly and rightwardly by a guide rod 43 mounting on the left and right side walls. The carriage 36 is movably driven leftwardly and rightwardly by a carriage driving motor controlled by the control unit. A holder part 44 at the top of the carriage 36 is provided with a printing heat (not shown), a ribbon cassette 45, and a correction ribbon 46. The holder part 44 is upwardly and downwardly oscillated by a lift mechanism around a pivot shaft 47, thereby switching the position of the holder part 44. Behind the carriage 36, the paper meter 37 along the front face of the platen 4 is disposed.

Figure 7:
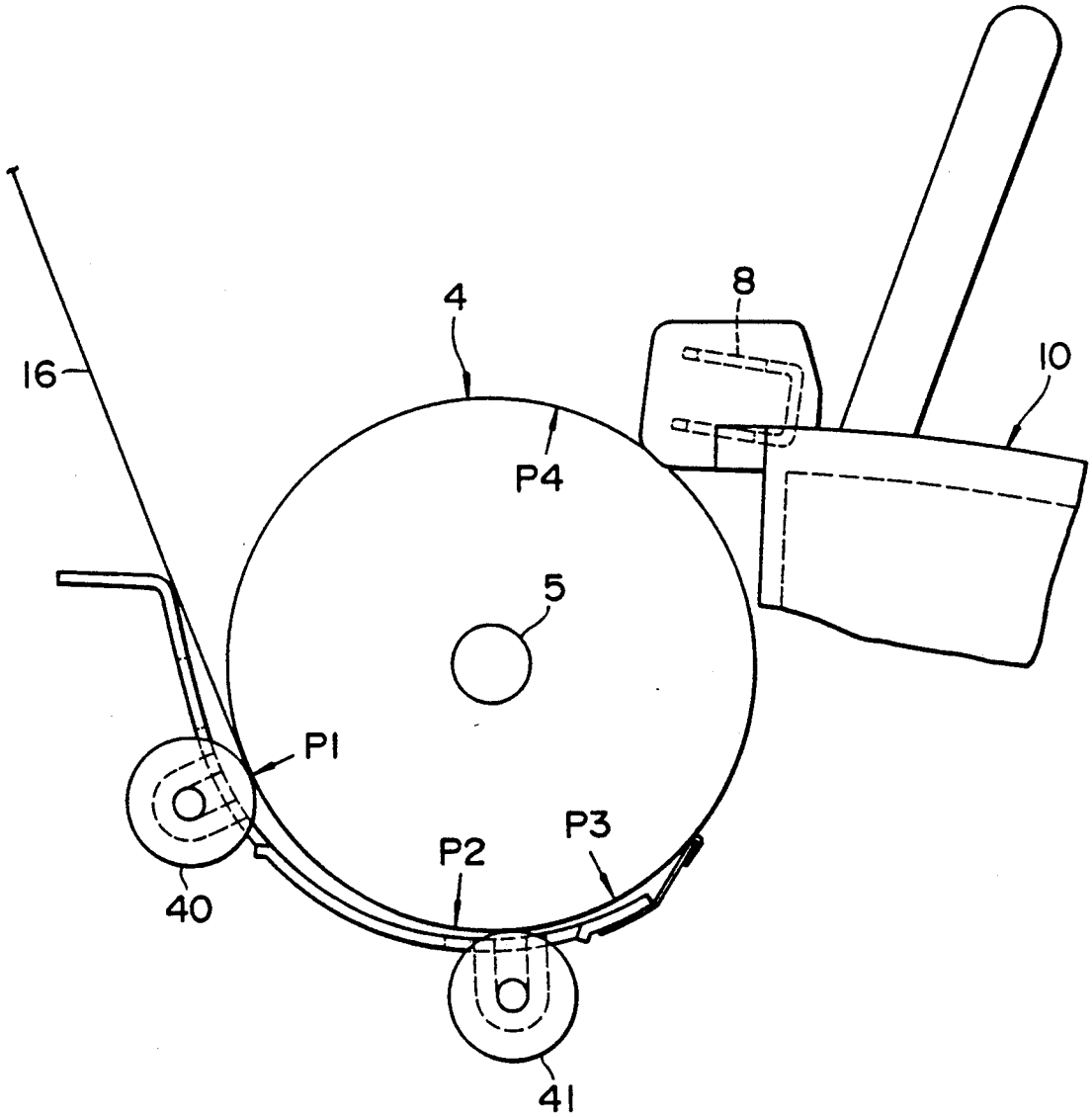
FIG. 7 is a descriptive schematic showing a positional relationship between the platen and a paper to be fed by the paper feed device according to the present invention.

As shown in FIG. 7, at the rear portion of the platen 4 and at the lower end of the platen 4, a plurality of paper feed rollers 40 and 41 which are arranged to be brought into contact with the platen 4 are disposed. A paper 16 is fed between the platen 4 and the rollers 40 and 41 along the platen 4. These paper feed rollers 40 and 41 are driven in accordance with the rotation of the platen 4. The lower portion at the front end of the carriage 36 is movably supported leftwardly and rightwardly by a guide part 42.

Figure 8:
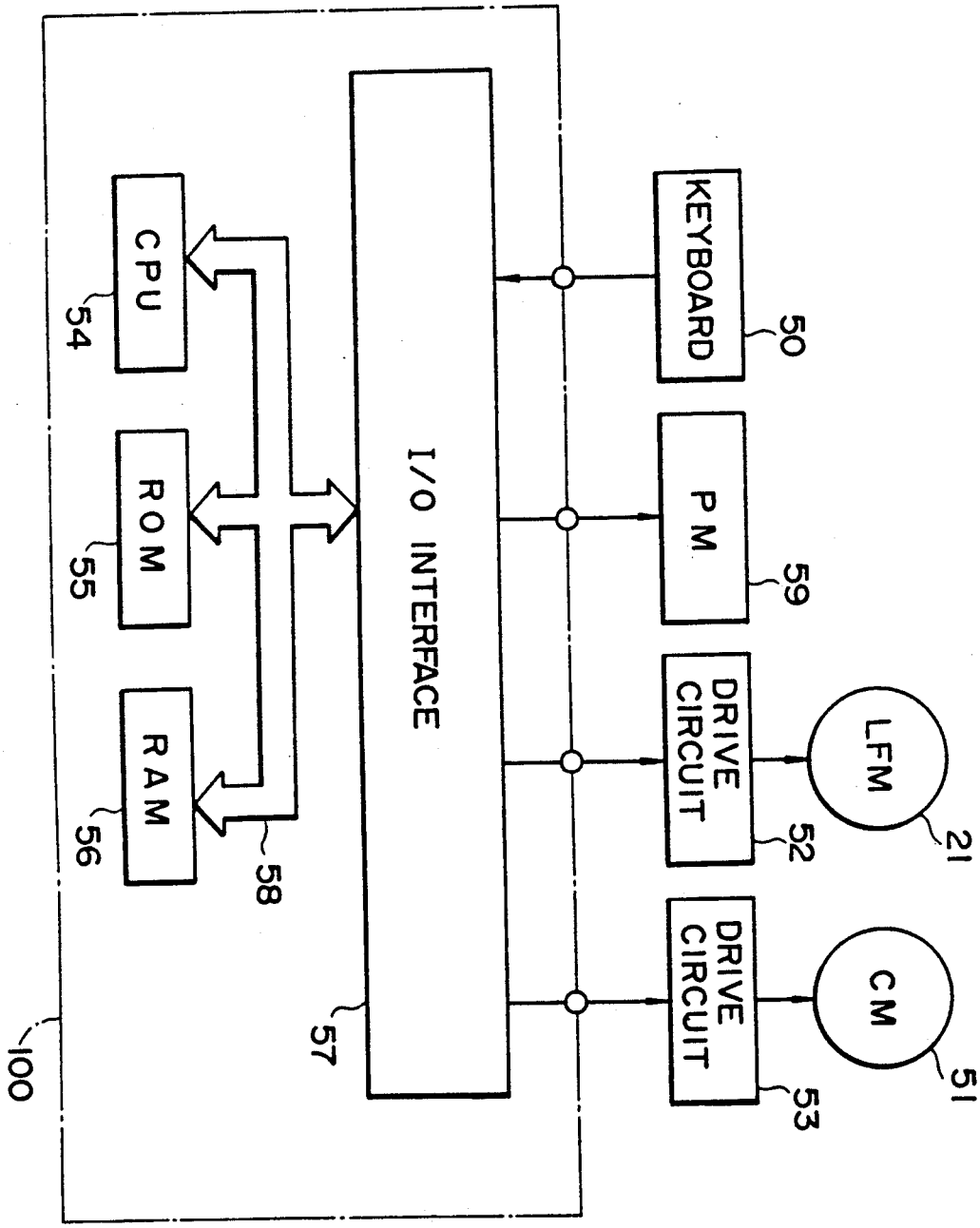
FIG. 8 is a block diagram of a control system for controlling an operation of the printing apparatus.

By referring to a block diagram of FIG. 8, the overall structure of a control system of the electronic typewriter is described hereinafter.

A printing mechanism 59 is provided with a printing element wheel which is housed in a wheel cassette, a driving motor thereof, a driving circuit thereof, a printing ribbon which is housed in a ribbon cassette 45, a takeup motor thereof, a driving circuit thereof, a printing hammer which knocks the printing element of the printing element wheel, a solenoid thereof, and a driving circuit thereof. The printing mechanism 59 is the same as that employed in a conventional electronic typewriter.

A driving circuit 53 is electrically connected to a line feed motor 21. An another driving circuit 53 is electrically connected to a carriage driving motor 51. A keyboard 50 which is provided with the paper insert key and so forth, the printing mechanism 59, and the driving circuits 52 and 53 are connected to an I/O interface 57 of the control unit 100.

The control unit 100 is provided with a CPU (Central Processing Unit) 54, the I/O interface 57 connected thereto through a bus 58 such as a data bus, a ROM (Read Only Memory) 55, and a RAM (Random Access Memory) 56.

The ROM 55 stores a control program for controlling the driving circuits 52 and 53, the printing mechanism 59, an automatic paper feed controlling program, described below, and so forth.

The RAM 56 is provided with a present position memory for sequentially storing various flags and the present position of the carriage 36, a printing data memory for storing data being inputted from the keyboard 50, and various memories for temporarily storing the results computed by the CPU 54.

On the inside of the side wall plate 2 over and adjacent to the operation engagement portion 34*b* of the release part 34, a detection switch, not shown, for detecting whether the carriage 36 has been placed in the leftmost side moving position is provided. As the release part 34 is rotated, the upper end of the operation engagement portion 34*b* is contacted with the detection switch which outputs an ON signal to the I/O interface 57.

Figure 9:
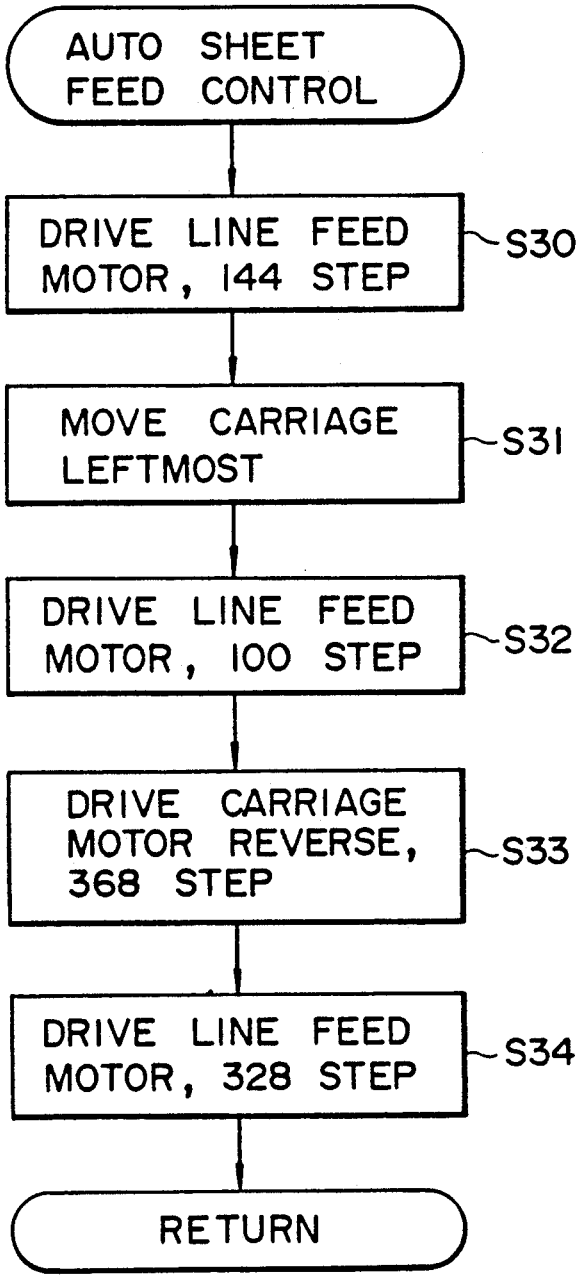
FIG. 9 is a flow chart of a paper feed operation executed by the paper feed device according to the present invention.

By referring to a flowchart of FIG. 9, a routine of the automatic paper feed control conducted in the control unit 100 of the electronic typewriter 1 is described hereinafter.

Figure 1B:
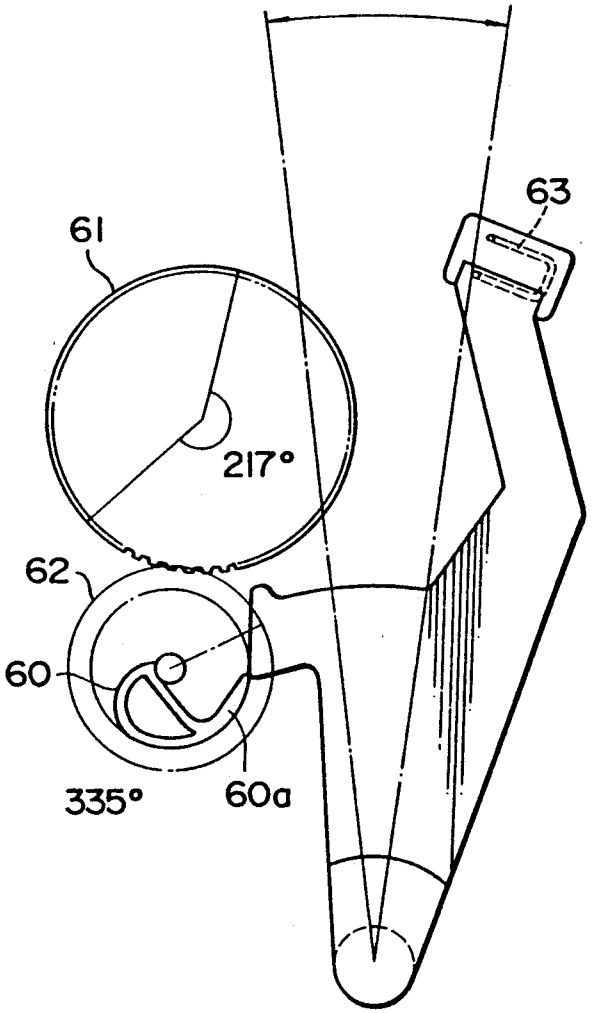
Figure 1A:
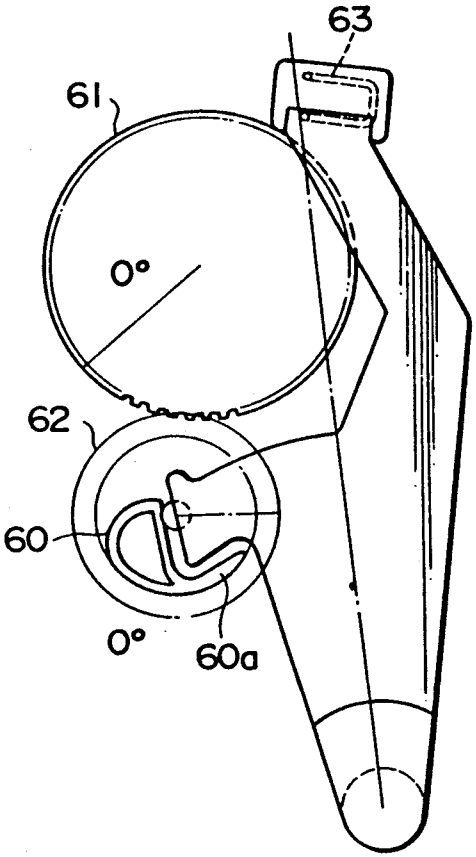

In the normal printing mode shown in FIG. 1, namely, when the intermittent gear 25 is placed in the non-engagement position and the second leaf spring 32 is placed in the locking position, if an operator sets, as shown in FIG. 7, a leading end of the printing paper 16 to the first paper feed position P1 (paper feed start position) which is fixed by a paper feed roller 40 and the platen 4 and then operates a paper insert key on the keyboard 50, an interrupt occurs against the main routine and thereby this control is started. The control goes to S30 and then the line feed motor 21 is rotated for 144 steps. Consequently, as the driven gear 7 is rotated through the driving gear 23 and the intermediate gear 20, the platen 4 is rotated. At the time, the printing paper 16 is continuously fed until the leading end of the printing paper 16 exceeds the paper feed roller 40 on the most upstream side and it arrives at the second paper feed position P2 which is a predetermined paper feed position upstream of the paper bail 8. By this paper feed operation, the printing paper 16 is fed for approx. 18 mm which is named a primary paper feed amount.

Figure 5:
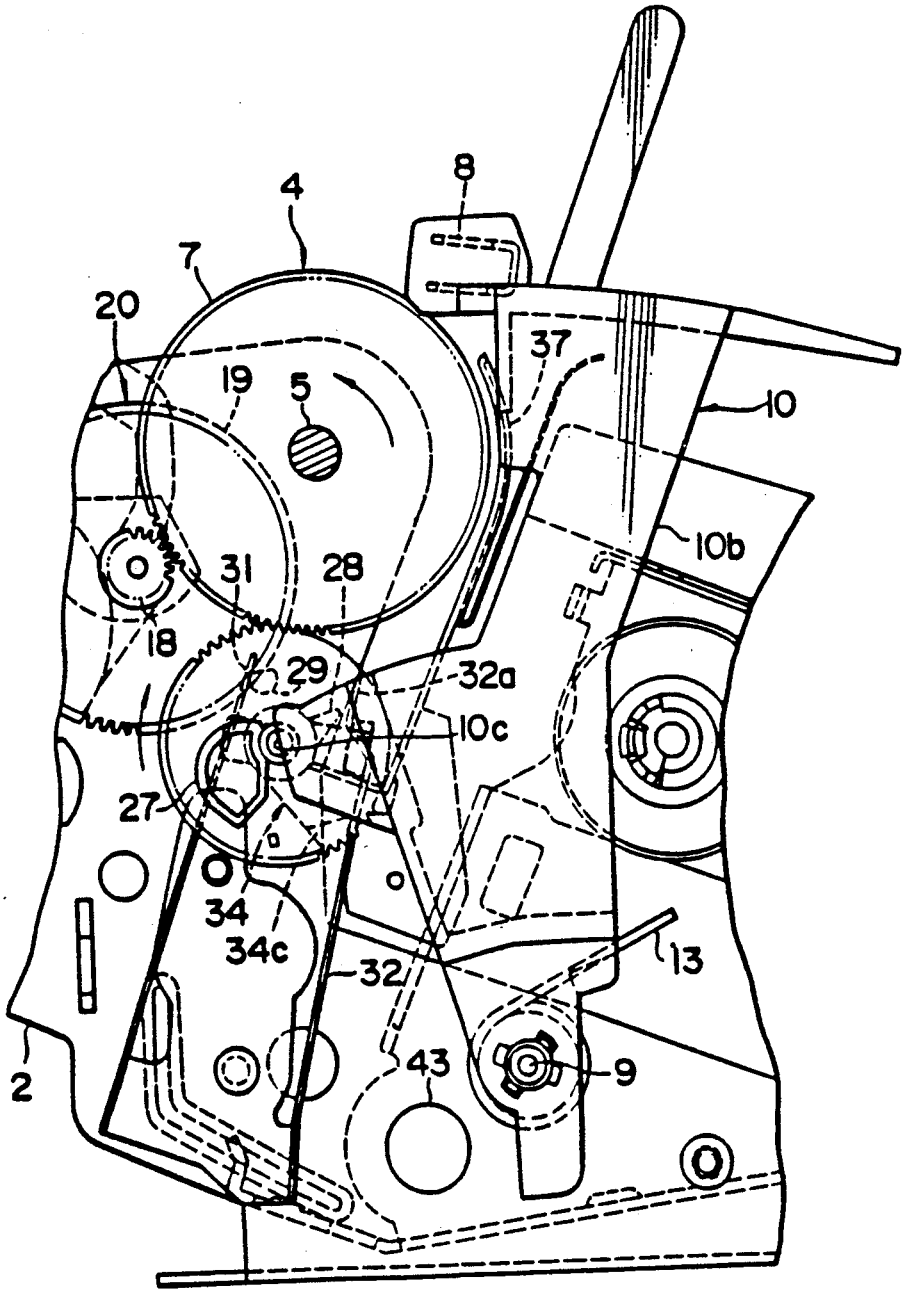
FIG. 5 is an enlarged side view of the principal section of the printing apparatus, wherein an intermittent gear is to be brought into engagement with a gear having been rotated with the platen.

In step S31, the carriage driving motor 51 is driven in accordance with data of the present position memory in the RAM 56 and the carriage 36 is moved to the side moving position where the carriage 36 is most close to the left side wall plate 2. At the time, the operation engagement portion **34*b* of the release part 34 is upwardly pushed by the operation cam piece 39 of the carriage 36. Therefore, the release part 34 is rotated counterclockwise for a predetermined angle, as shown in FIG. 5. The second leaf spring 32 is pushed to the fixing release position by the release part 34*c* of the release part 34. Therefore, the intermittent gear 25 is rotated clockwise to a position where a gear tooth at the leading edge of the intermittent gear 25 are engaged with the driven gear 7 by an elastic force of the first leaf spring 31. The position of the intermittent gear 25** is named an engagement enable position.

After that, in step S32, the line feed motor 21 is driven for 100 steps. Thereby, when the driven gear 7 is rotated for a predetermined angle in the paper feed direction (counterclockwise direction in FIG. 7), the intermittent gear 25 is securely engaged with the driven gear 7 and the printing paper 16 is fed to a third paper feed position P3. The position of the intermittent gear 25 is named a release start position.

After that, in step 33, by driving the carriage driving motor 51 in the reverse direction for 368 steps, the carriage 36 is moved to the nearly center position of the left and right side wall plates. At the time, since the operation cam piece 39 does not push the operation engagement portion 34, the release part 34 is returned back to the origin and the second leaf spring 32 is contacted with the stopper 28. However, since the intermittent gear 25 is brought into engagement with the driven gear 7, the intermittent gear 25 is not rotated in the reverse direction.

Figure 6:
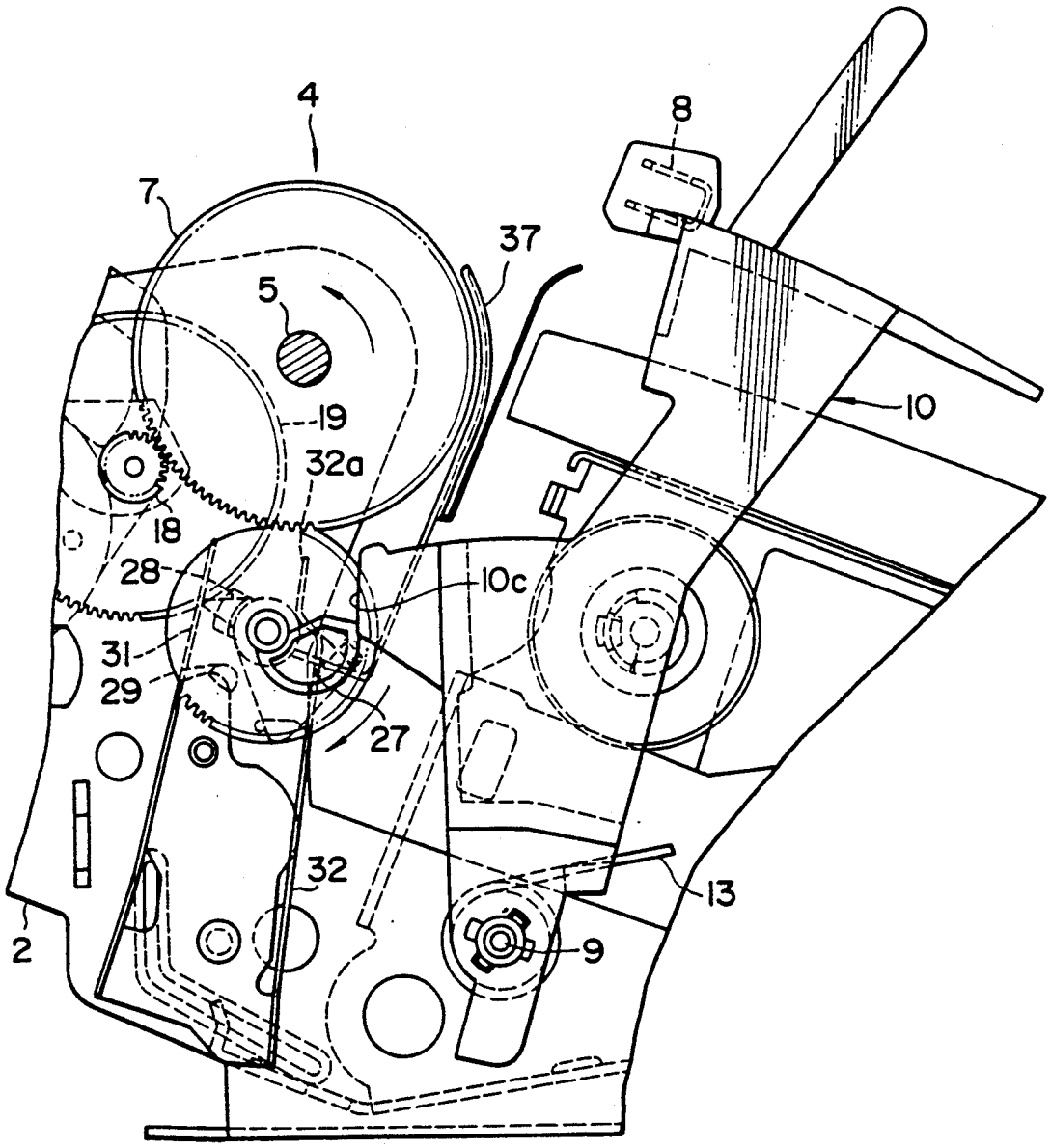
FIG. 6 is the enlarged side view, wherein the platen and the paper bail are brought out of contact with each other, while the intermittent gear is to be brought out of engagement from the gear.

In step S34, the line feed motor 21 is driven for 328 steps. After that, the control returns back to the main routine. At the time, is shown in FIG. 6, since the driven gear 7 is further rotated in the paper feed direction, the intermittent gear 25 is rotated clockwise and the release cam 27 is slidably contacted with the cam driven portion **10*c* of the paper bail arm 10. Thereby, the paper bail 8 is kept in a position at which the paper bail 8 is brought out of contact with said platen 4. At the time, the printing paper 16 is securely fed between the platen 4 and the paper bail 8. The leading end of the printing paper 16 is stopped at a fourth paper feed position P4 shown in FIG. 7 which is approx. 25.4 mm higher position than the printing position. During the operation of the release mechanism 24, the printing paper is fed for approx. 55 mm and a gear tooth of the trailing edge of the intermittent gear 25 is disengaged from the driven gear 7. After that, the intermittent portion 25*a* is moved to a position opposed to the driven gear 7. At the time, the paper bail 8 is moved to the contact position and the second leaf spring 32 fixes the stopper 28 agains as shown in FIG. 2**.

Further, when a cover of the printing apparatus 1, not shown, is opened for replacing the printing ribbon and so forth, the carriage 36 is moved to the side moving position so as to set the origin. At the time, the release part 34 is rotated by the operation cam piece 39 and the intermittent gear 25 is switched to the position shown in FIG. 5. At the time, since the contacting portion **32*a* of the second leaf spring 32 is opposed to the front of the stopper 28, after the carriage 36 is moved in the center direction (rightwardly), the second leaf spring 32 backwardly pushes the release operation portion 34*c* of the release part 34 and the contact portion 32*a* pushes the stopper 28 back to the fixing position. Thereby, the intermittent gear 25 is switched in the position shown in FIG. 2**.

It may be considered that a reflection type photo sensor for detecting the front end of the printing paper 16 at a predetermined position between the paper feed roller 40 or 41 and the paper bail 8 adjacent to the outer periphery of the platen 4 is provided. In S30, when the line feed motor 21 is driven and a detection signal which represents that a leading end of the printing paper 16 has been detected from the reflected type photo sensor, it is possible to control so that the process can advance to S31. With this operation, a paper feed trouble such as paper feed delay due to a slippage of the printing paper on the paper feed rollers 40 and 41 and the platen 4 can be prevented. When a detection signal is not inputted from the reflection type photo sensor within a predetermined period of time, by using a display unit a buzzer, and the like, the paper feed trouble can be informed to the operator.

As described above, when the automatic paper feed control is started, a leading end of the printing paper 16 is primarily fed from the first paper feed position P1 (paper feed start position) to the second paper feed position. After that, during the operation of the release mechanism 24, for the remaining of the overall paper feed amount necessary for the automatic paper feed operation (the paper feed amount from the first paper feed position P1 to the fourth paper feed position P4), the printing paper is secondarily fed from the second paper feed position P2 to the fourth paper feed position P4.

In other words, the overall paper feed amount of the printing paper 16 necessary for the automatic paper feed operation can be obtained by the primary paper feed amount and the second paper feed amount for which the release mechanism 24 operates. The primary paper feed amount is the paper feed amount where the secondary paper feed amount is subtracted from the overall paper feed amount. Thereby, the shape of the release cam 27 and the diameter of the intermittent gear 25 can be freely designed irrespective of the diameter of the driven gear 7. Depending on such designing factors, the secondary paper feed amount is determined. In accordance with the secondary paper feed amount, the primary paper feed amount can be determined. Thus, the secondary paper feed amount can be freely set, so that the diameter of the intermittent gear 25 and the shape of the release cam 27 can be freely designed.

Consequently, the degree of freedom in designing the release mechanism 24 including the intermittent gear 25 and the release cam 27 can be remarkably improved. Therefore, it is possible to design the intermittent gear 25 in a small size and the release cam 27 in a small size and with a simple structure and high durability.

In the automatic paper feed device for a printing apparatus according to the present invention, when an automatic paper feed mode is designated by a paper insert key and so forth, since the drive motor drives the platen for a predetermined rotation angle, so that the platen is rotated through the driven gear and the paper feed roller is also rotated. Thereby, the printing paper is preparatorily fed until a leading end of the paper arrives at an predetermined position upstream of the paper bail. After that, the carriage is moved to a left side moving position near the apparatus frame. Therefore, it is possible to minimize a width length of the printing apparatus and to make a weight of the printing apparatus light since a predetermined position, the left most position in this embodiment, is designated as an original position of the carriage and as a release starting position at which the releasing operation is started. It is further possible to execute a designation of the original position of the carriage with a so-called out of step method in which the designation of the original position is executed by means of the out of step of a drive motor for driving the carriage.

Further, it is possible to decrease a number of parts used in the printing apparatus since the leaf springs are integrally formed with a common plate, and it becomes possible to decrease a production cost.

What is claimed is:

1. A paper feed device comprising:

a platen member arranged to be rotated by a drive motor member;

a paper bail member provided parallel to said platen member, said platen member and said paper bail member being arranged to be relatively movable with each other so that said paper bail member is arranged to be brought into and out of contact with said platen member;

a first biasing member for generating a first biasing force for biasing said paper bail member toward said platen member, and;

control means for controlling said drive motor member, said platen member and said paper bail member in such a manner that said platen member and said paper bail member are brought out of contact after said platen member is driven to be rotated at a first predetermined angle, while said platen member and said paper bail member are brought into contact with each other after said platen member is further driven to be rotated at a second predetermined angled said control means comprising actuate means for actuating said paper bail member so as to be brought out of contact from said platen member; inhibit means for inhibiting by said actuate means; and release means for releasing said inhibit means in case said platen member is driven to be rotated between said first and said second predetermined angles.

2. The paper feed device according to claim 1 wherein said actuate means comprises:

a gear member arranged to be integrally rotated with said platen member;

an intermittent gear member provided with a threaded portion engageable with a threaded portion of said gear member in a range corresponding to an angle between said first and second predetermined angles;

a support member; and a cam portion integrally rotatable with said intermittent gear member and arranged to push a predetermined portion of said support member, integrally movable with said paper bail member, for supporting said paper bail member during which said platen member is driven to be rotated between said first and second predetermined angles;

whereby said paper bail member being brought out of contact from said platen member during said platen member is driven to be rotated between said first and second predetermined angles.

3. The paper feed device according to claim 2 wherein said inhibit means comprises a stopper member provided on said intermittent gear member and a contact member arranged to be contacted with said stopper member.

4. The paper feed device according to claim 3 wherein said release means comprises a release mechanism for releasing the contact operation between said stopper member and said contact member and a second biasing member for biasing said intermittent gear member, through a projection portion provided on said intermittent gear member, to be brought into engagement with said gear member.

5. The paper feed device according to claim 4 wherein said contact member and said second biasing member respectively comprise an elastic plate member which is integrally formed with a common plate member.

6. The paper feed device according to claim 4 further comprising a carriage member movable along said platen member and a cam portion provided on said platen member wherein said release mechanism comprises a release member, independently movable with said intermittent gear member for releasing the contact operation between said stopper member and said contact member in case that a predetermined portion of said release member is contacted with said cam portion on said carriage member, said predetermined portion of said release member and said cam portion being arranged to be contacted with each other in case that said carriage member is located at a predetermined position.

7. The paper feed device according to claim 6 wherein said platen member is driven to be rotated at said first predetermined angle before said carriage member is located at said predetermined position.

8. The paper feed device according to claim 6 wherein said predetermined position is the side edge position of an area in which said carriage member is moved.

9. A paper feed device comprises:

a platen member having a driven gear member at one end thereof arranged to be rotated by a drive motor member;

a paper bail member provided parallel to said platen member, said platen member and said paper bail member being arranged to be relatively movable with each other;

an intermittent gear member provided with a threaded portion engageable with said driven gear member in a predetermined range of angle, said intermittent gear member having a cam portion integrally rotatable with said intermittent gear member; and actuate means for actuating at least one of said platen member and said paper bail member so as to be brought out of contact from the other in case that said driven gear member and said intermittent gear member are brought into contact with each other said support means comprises a supporting member for supporting said paper bail member, integrally movable with said paper bail and having a contact portion arranged to contact said cam portion in said predetermined angle range, a biasing member for biasing said intermittent gear member at a predetermined biasing force, stop means for stopping said intermittent gear member so as not to be engaged with said driven gear member against said predetermined biasing force; and release means for releasing a stopping operation to be executed by said stop means in case said stop means becomes a predetermined state.

10. The paper feed device according to claim 9 wherein said stop means comprises a stopper member provided on said intermittent gear member and an another biasing member arranged to be contacted with said stopper member for biasing said intermittent gear member against said predetermined biasing force.

11. The paper feed device according to claim 10 further comprising a carriage member movable along said platen, a cam portion provided on said carriage member and wherein said release means comprises a release member for releasing the contact operation between said stopper member and said another biasing member, and said predetermined state is that said release member is contacted with said cam portion in case that said carriage member is located at the side edge position of an area in which said carriage member is moved.

12. The paper feed device according to claim 11 wherein said biasing member and said another biasing member respectively comprise an elastic plate member which is integrally formed with a common plate member.

13. The paper feed device according to claim 9 which further comprises at least one roller member arranged to be brought into contact with said platen member.

14. A shift mechanism adapted to be positioned in a paper feed device, including at least a platen member arranged to be rotated by a drive motor member and a paper bail member provided parallel to said platen member and arranged to be brought into and out of contact with said platen member, for shifting said paper bail member between a first position in which said paper bail member is brought into contact with said platen member and a second position in which said paper bail member is brought out of contact with said platen member; said shift mechanism comprising;

control means for controlling said paper bail member so as to be brought out of contact with said platen member; said control means comprising a gear member arranged to be integrally rotated with said platen member;

an intermittent gear member provided with a threaded portion engageable with a threaded portion of said gear member in a range corresponding to an angle between first and second predetermined angles;

a support member, integrally movable with said paper bail member, for supporting said paper bail member when said platen member is driven to be rotated between said first and second predetermined angles; and a cam portion integrally rotatable with said intermittent gear member and arranged to push a predetermined portion of said support member; and inhibit means for inhibiting a control operation to be executed by said control means; and release means for releasing an inhibit operation to be executed by said inhibit means in case that said platen member is driven to be rotated between said first predetermined angle and said second predetermined angle.

15. The shift mechanism according to claim 14 wherein said inhibit means comprises a stopper member provided on said intermittent gear member and a contact member arranged to be contacted with said stopper member, and wherein said release means comprises a release mechanism for releasing the contact operation between said stopper member and said contact member and a biasing member for biasing said intermittent gear member, through a projection portion provided on said intermittent gear member, to be brought into engagement with said gear member.

16. The shift mechanism according to claim 15 wherein said contact member and said biasing member respectively comprise an elastic plate member which is integrally formed with a common plate member.

* * * * *